US009295370B1

(12) United States Patent
Barlow

(10) Patent No.: US 9,295,370 B1
(45) Date of Patent: Mar. 29, 2016

(54) SANITATION DEVICE AND SYSTEM

(71) Applicant: DR. JOHN'S LABS LLC, Jackson, WY (US)

(72) Inventor: David George Barlow, Jackson, WY (US)

(73) Assignee: DR JOHN'S LABS LLC, Jackson, WY (US)

( * ) Notice: Subject to any disclaimer, the term of this patent is extended or adjusted under 35 U.S.C. 154(b) by 0 days.

(21) Appl. No.: 14/877,529

(22) Filed: Oct. 7, 2015

Related U.S. Application Data

(60) Provisional application No. 62/062,667, filed on Oct. 10, 2014.

(51) Int. Cl.

| | |
|---|---|
| ***A47L 17/02*** | (2006.01) |
| ***A47L 21/00*** | (2006.01) |
| ***A46B 3/22*** | (2006.01) |
| *A47L 11/00* | (2006.01) |

(52) U.S. Cl.
CPC . *A47L 17/02* (2013.01); *A46B 3/22* (2013.01); *A47L 11/00* (2013.01)

(58) Field of Classification Search
CPC .. A46B 11/00; A46B 11/001; A46B 11/0062; A46B 11/0065; A47L 21/00; A47L 21/04; A47L 17/00; A47L 17/02; A47K 5/00
USPC ..... 15/104.92, 117; 4/627, 628, 629, 630, 4/631, 632, 634, 638, 644, 657, 654
See application file for complete search history.

(56) References Cited

U.S. PATENT DOCUMENTS

| | | | | |
|---|---|---|---|---|
| 919,844 | A | 4/1909 | Ford | |
| 929,947 | A | 8/1909 | Hertzberg | |
| 1,603,560 | A | 10/1926 | Skinner | |
| 1,930,571 | A | 10/1933 | Traxl | |
| 4,872,235 | A * | 10/1989 | Nielsen | A45D 24/44 15/104.92 |
| 5,652,993 | A | 8/1997 | Kreyer | |
| 5,683,655 | A * | 11/1997 | Carter | A61L 2/18 134/6 |
| D486,307 | S | 2/2004 | Rogers | |

(Continued)

FOREIGN PATENT DOCUMENTS

WO 2011149477 A1 12/2011

OTHER PUBLICATIONS

PCT Application No. PCT/US15/54558, International Search Report and Written Opinion, dated Jan. 11, 2016, 17 pages.

*Primary Examiner* — Laura C Guidotti
(74) *Attorney, Agent, or Firm* — Lathrop & Gage LLP

(57) ABSTRACT

Systems and methods for sanitizing utensils are disclosed. A system for sanitizing a utensil includes a shelf removably attached to a counter; an attachment member adjustably secured to the shelf, the attachment member having an aperture formed therein; a container received into the aperture in the attachment member, the container being configured to hold a sanitizing solution; and a removable insert located along an upper periphery of the container. The removable insert has a first cleaning rod extending between opposing first and second sides of the insert; a partition extending between the opposing first and second sides of the insert parallel to the first cleaning rod to form a debris channel, the debris channel having a floor thereunder; and at least one scraping member secured to an upper rim of the insert. The first cleaning rod is not located in the debris channel.

10 Claims, 7 Drawing Sheets

(56) References Cited

U.S. PATENT DOCUMENTS

| | | | | |
|---|---|---|---|---|
| D663,531 | S | 7/2012 | Zemel | |
| 8,898,847 | B2 | 12/2014 | Farrell | |
| 9,247,860 | B2 * | 2/2016 | Albright | A47L 21/04 |
| 2011/0179593 | A1 | 7/2011 | Albright | |
| 2012/0193313 | A1 | 8/2012 | Spurr et al. | |

* cited by examiner

SANITATION DEVICE AND SYSTEM

CROSS-REFERENCE TO RELATED APPLICATIONS

This application claims priority to U.S. Provisional Patent Application No. 62/062,667, filed Oct. 10, 2014, which is incorporated herein by reference in its entirety.

BACKGROUND

Preventing cross-contamination of food surfaces (such as utensils) and microbial growth on poorly cleaned or soiled surfaces is important to ensure the safety of the public. Cross-contamination can occur not just when a utensil comes into contact with multiple food sources, but can also occur when the utensil touches a common allergen, such as nuts. Additionally, microorganism growth can occur when utensils are improperly cleaned, or are not cleaned in a timely manner which may cause adverse effects to the public.

It is known that microorganisms may grow on food that is left out at room temperature for more than four hours, and in particular, prime microorganisms growth occurs between 40° F. and 140° F. Food surfaces coming into contact with food that has not been prepared or refrigerated properly can cause contamination, causing harmful effects if ingested. Maintaining clean and sanitized surfaces that come into contact with food, such as knives and other utensils, is thus an integral part of the food service industry.

SUMMARY

The following presents a simplified summary of the invention in order to provide a basic understanding of some aspects of the invention. This summary is not an extensive overview of the invention. It is not intended to identify critical elements or to delineate the scope of the invention. Its sole purpose is to present some concepts of the invention in a simplified form as a prelude to the more detailed description that is presented elsewhere.

According to one embodiment of the invention a system for sanitizing a utensil includes a shelf removably attached to a counter; an attachment member adjustably secured to the shelf, the attachment member having an aperture formed therein; a container received into the aperture in the attachment member, the container being configured to hold a sanitizing solution; and a removable insert located along an upper periphery of the container. The removable insert has a first cleaning rod extending between opposing first and second sides of the insert; a partition extending between the opposing first and second sides of the insert parallel to the first cleaning rod to form a debris channel, the debris channel having a floor thereunder; and at least one scraping member secured to an upper rim of the insert. The first cleaning rod is not located in the debris channel.

According to another embodiment of the invention, a shelf for receiving a system for sanitizing utensils has a receiving rack having at least one opening formed therein for receiving a container for holding sanitizing solution, at least one wall for supporting the receiving rack, and at least one mounting bracket for mounting the wall to a counter. An upper periphery of the container is equipped with a removable insert having a plurality of cleaning rods secured between opposing sides of the removable insert and a plurality of scraping members secured to an upper rim of the removable insert.

According to yet another embodiment of the invention, a method for sanitizing a utensil includes the following steps: (a) providing a removable shelf for attachment to a counter; (b) filling the container with the sanitizing solution; (c) scraping excess debris off of the utensil into the debris channel via one of the plurality of scraping members; (d) inserting the utensil through the insert into the container such that the utensil touches at least one of the cleaning rods and comes into contact with the sanitizing solutions; (e) partially extracting the utensil from the container such that the utensil comes into contact with at least one of the cleaning rods; (f) repeating steps (d) and (e) until the utensil is clean and sanitized; (g) removing the utensil from the container and the insert; and (h) wiping the excess sanitizing solution on another of the plurality of scraping members. The shelf has a receiving rack having a first opening formed therein for receiving a container for holding sanitizing solution, at least one wall for supporting the receiving rack; and at least one mounting bracket for mounting the wall to a counter. An upper periphery of the container is equipped with a removable insert having a plurality of cleaning rods secured between opposing sides of the removable insert; a partition extending between the opposing sides of the insert to form a debris channel, the debris channel having a floor thereunder; and a plurality of scraping members secured to an upper rim of the removable insert.

WRITTEN DESCRIPTION

All states have food services codes and regulations that prescribe acceptable methods and times for cleaning utensils such as kitchenware (e.g., knives, spoons, etc.), equipment, tools, etc. However, maintaining this appropriate level of cleanliness also relies on the common sense of those persons responsible for ensuring that the codes and regulations are being complied with. For example, it is well known that debris that has not been removed from a soiled utensil may prevent proper sanitation of the utensil. Thus, it is imperative that the debris be removed prior to the sanitation process. Additionally, depending on the foodstuffs that the utensil is used with, the utensil may need to be cleansed very frequently. Thus, sanitation processes can often be laborious and time intensive, which is especially inconvenient during high service periods, such as lunch and dinner. Occasionally, and often in an effort to provide fast and reliable service for the customer, steps for cleaning utensils are forgotten about or skipped. Accordingly, it would be desirable to have a simplified system that may be used to better ensure proper cleaning and sanitization of utensils.

Figure 1:
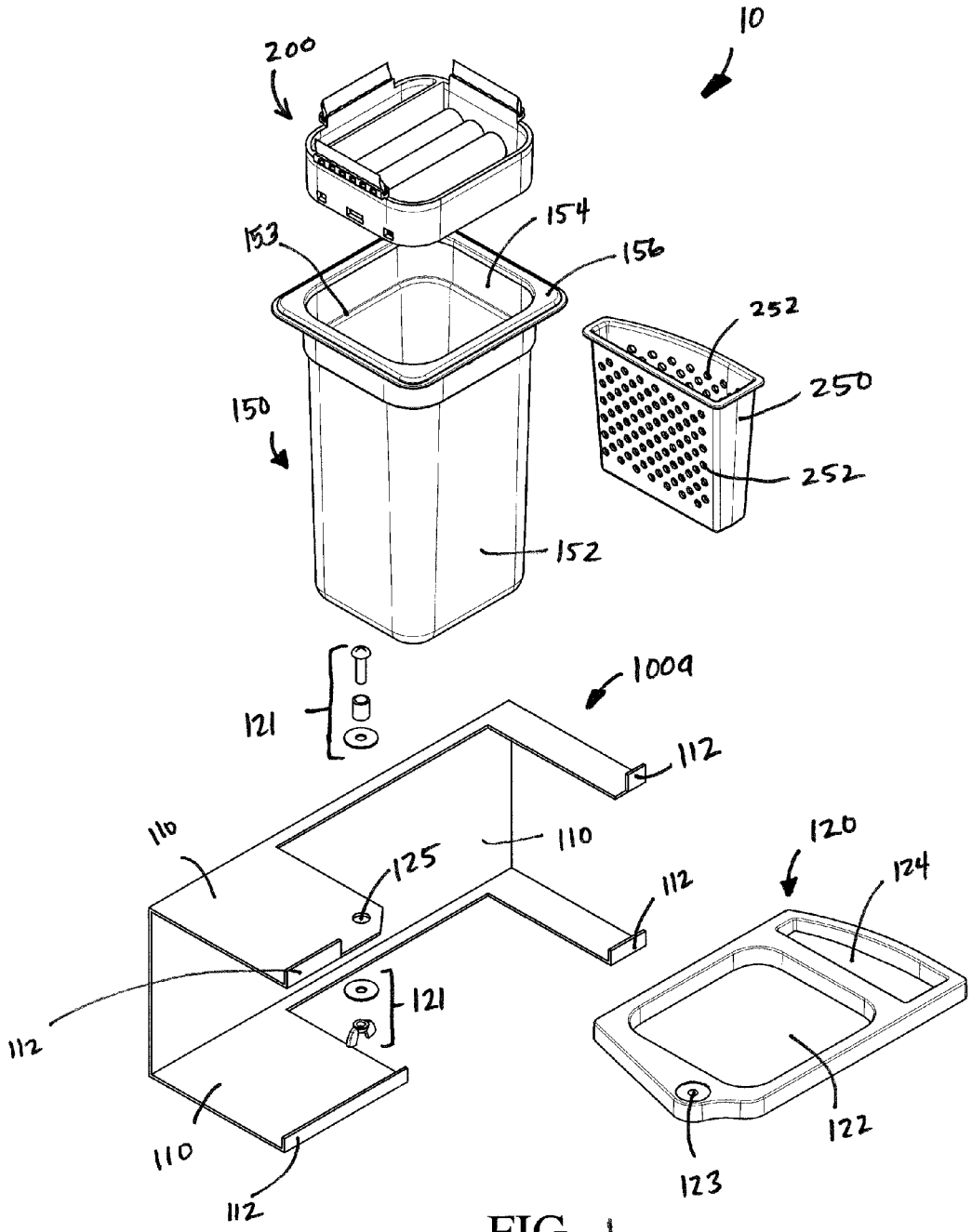
FIG. 1 is a blown up perspective view of a sanitation device system according to one embodiment of the invention.

Systems and methods for providing sanitized utensils are provided herein. Referring to FIG. 1, in one embodiment, a system 10 generally includes a shelf (generally, 100), a container 150 for holding a cleaning solution, and a removable insert 200.

Figure 2:
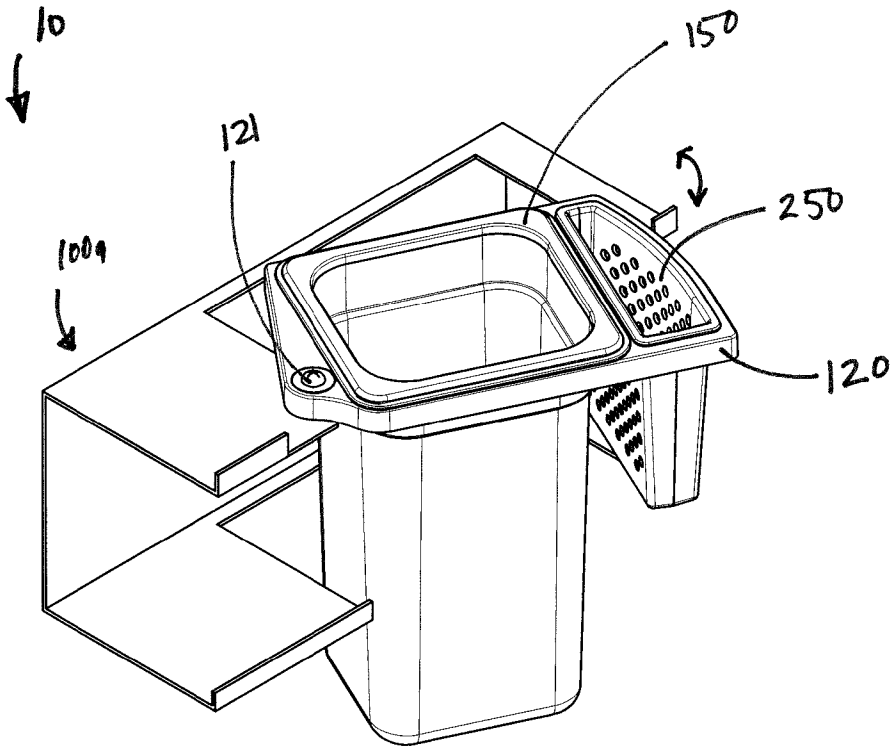
FIG. 2 is a perspective view of the sanitation device system of FIG. 2

The shelf 100 may take various embodiments, and FIGS. 1, 2, and 5-7 illustrate various exemplary embodiments of shelves 100. As shown in FIG. 1, the shelf 100*a* may have horizontal and vertical supporting walls 110 and may include an attachment 120 which may be removably secured to the shelf 100*a* via a mechanical fastener such as a bolt and wing nut construction 121, as shown in FIGS. 1 and 2, inserted through attachment points 123 and 125 located on the attachment 120 and shelf 100*a*, respectively. The mechanical fastener 121 may allow the attachment 120 to rotate between a closed position and an open position (see FIG. 2). The attachment 120 may have a void 122 for receiving the container 150 (and thus the removable insert 200 as described herein). Optionally, the attachment 120 may additionally have a void 124 for receiving, for example, a drying basket 250. Other voids may also be provided.

Figure 5:
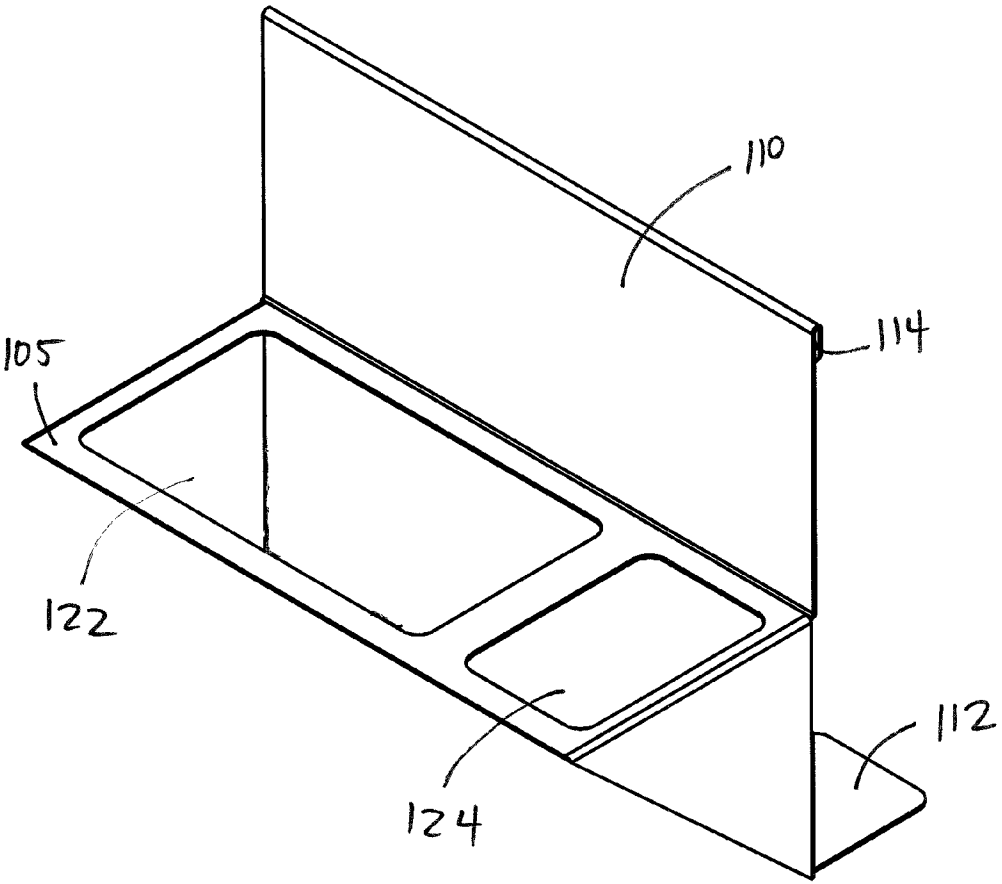
FIG. 5 is perspective view of a shelf for receiving a sanitation device system according to one embodiment.
Figure 6:
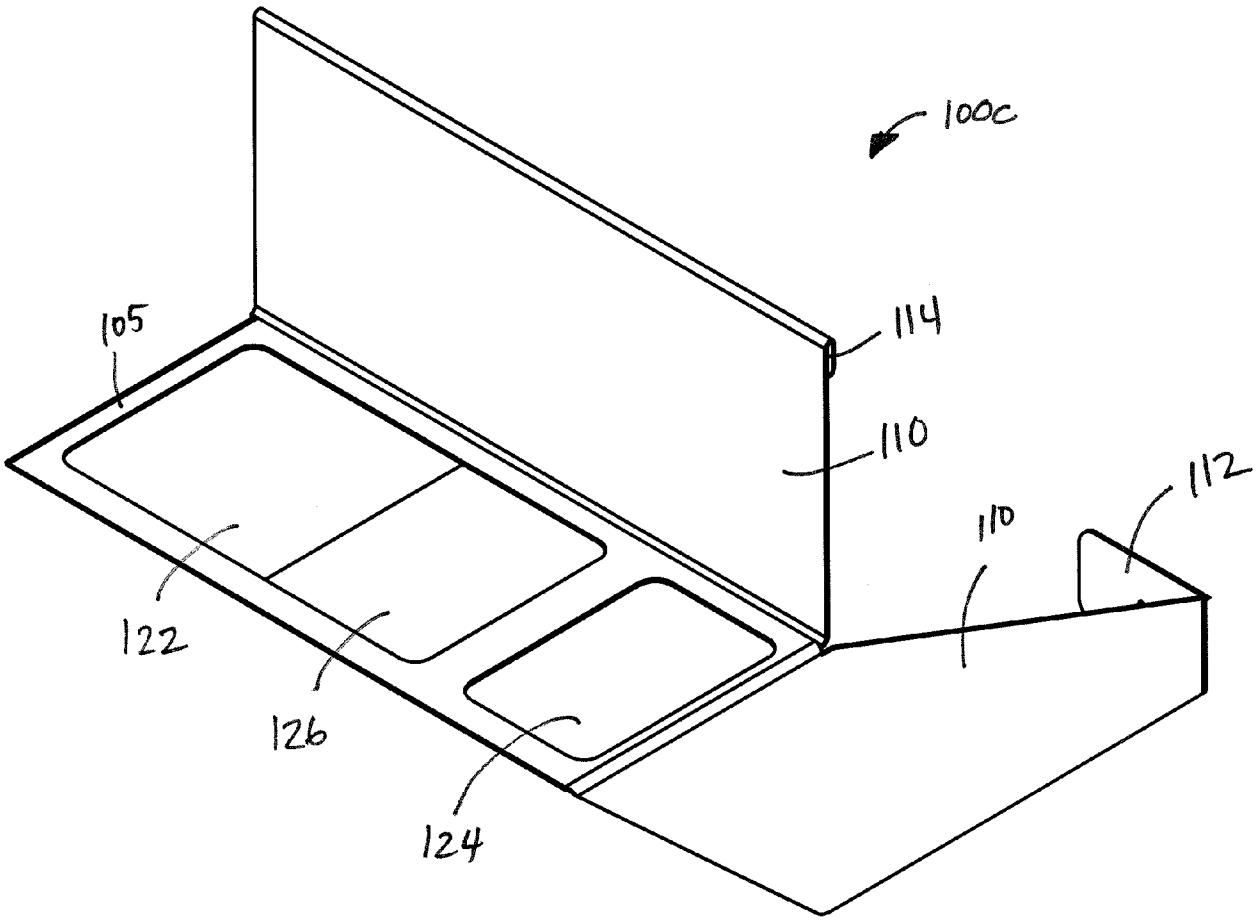
FIG. 6 is another perspective view of a shelf for receiving a sanitation device system according to another embodiment.
Figure 7:
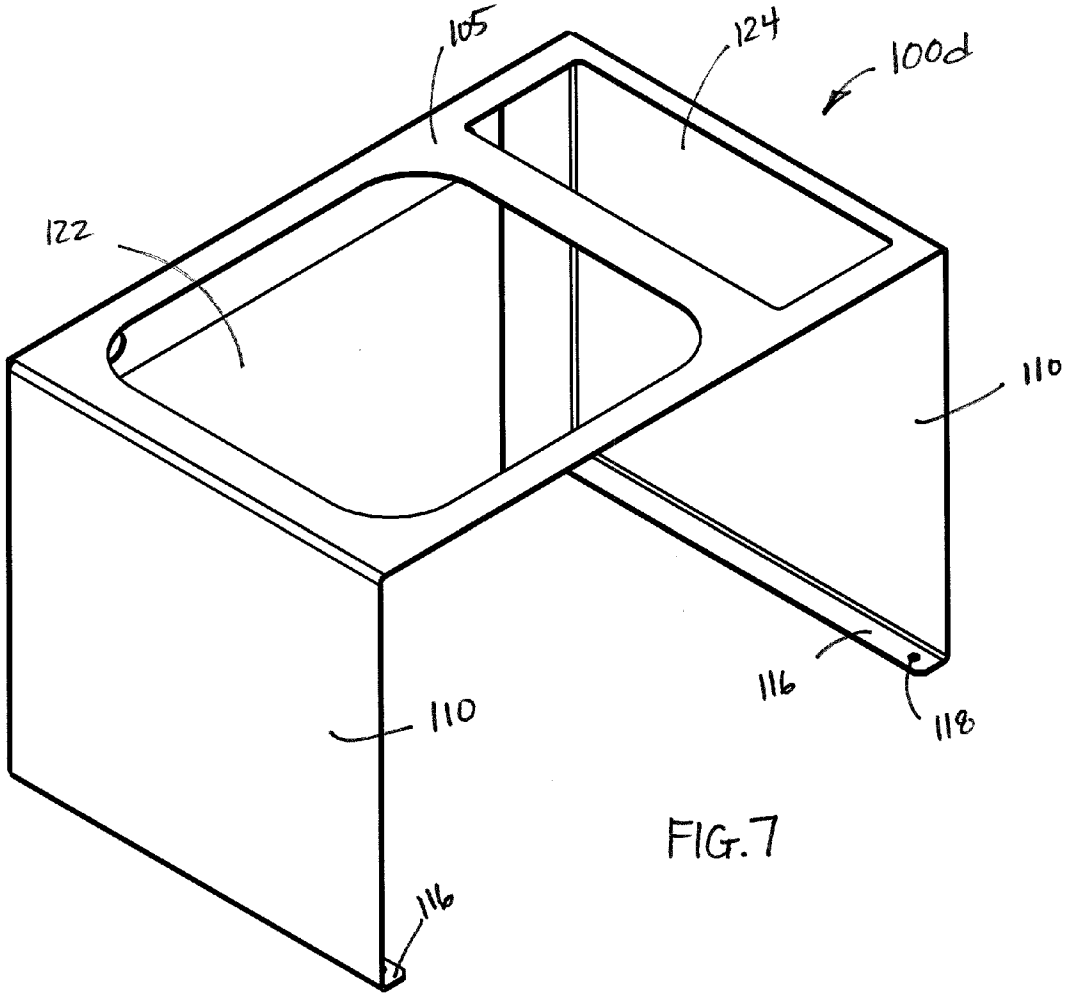
FIG. 7 is yet another perspective view of a shelf for receiving a sanitation device system according to still another embodiment.

Alternately, as shown in FIGS. 5-7, the shelf 100*b*, 100*c*, 100*d* may include a receiving rack 105 which may have a void 122 for receiving the container 150 and optionally additional voids, such as void 124 for receiving the drying basket. Still additional voids 126 may also be provided to hold various other structures (e.g., as shown in FIG. 6). Walls 110 may provide support for the receiving rack 105.

The shelf 100 may be configured to attach to, or otherwise interact with, an existing countertop. Accordingly, the shelf 100 may have various brackets and/or supports for securing the shelf 100 to the counter. In FIGS. 1, 5, and 6, the shelf 100 may attach to the counter via mounting brackets 112 and/or clips 114. The brackets 112 and/or clips 114 may be secured to the counter with mechanical fasteners (e.g., screw, nail, rivet, nut and bolt, etc.) to maintain the shelf 100 in position at the counter. FIG. 7 illustrates an example of a shelf 100 that is designed to sit atop the counter. Base portions 116 engage with the top of the counter, and mechanical fasteners may be inserted through apertures 118 formed therein to secure the shelf 100 to the counter.

In some embodiments, the shelf 100 may be positioned where users of the system 10 may accidentally come into contact with edges of the shelf 100. Accordingly, the edges of the shelf 100 may be covered with, for example, a rubber or plastic bumper to minimize possible injuries as a result of coming into contact with the shelf.

The container 150 has a containment area 152 extending downwardly from an upper periphery 154. The perimeter of the upper periphery 154 may be slightly larger than the perimeter of the containment area 152 to form an edge 153. A lip 156 may be provided around the edge of the upper periphery 154 of the containment area 152. The perimeter of the lip 156 may be slightly larger than the perimeter of the void 122 in the attachment 120 such that the container 150 is maintained in the void 122. In embodiments, the container 150 may be, for example, a ⅙ size, 6" deep food pan (e.g., Cambro® pan). It shall be noted that other sized (and shaped) pans may additionally, or alternately, be used.

The container 150 is configured to hold an antimicrobial agent. There are many antimicrobial agents which may be acceptable with the system 10, including but not limited to oxidizing agents, phenolics, thymol-based disinfectants, alcohols, et cetera. Due to the potentially corrosive nature of particular antimicrobial agents that may be used, it may be preferable for the container 150 to be constructed of a material that is resistant to such corrosion. Exemplary materials include but are not limited to aluminum, stainless steel, ceramic, et cetera.

Figure 3:
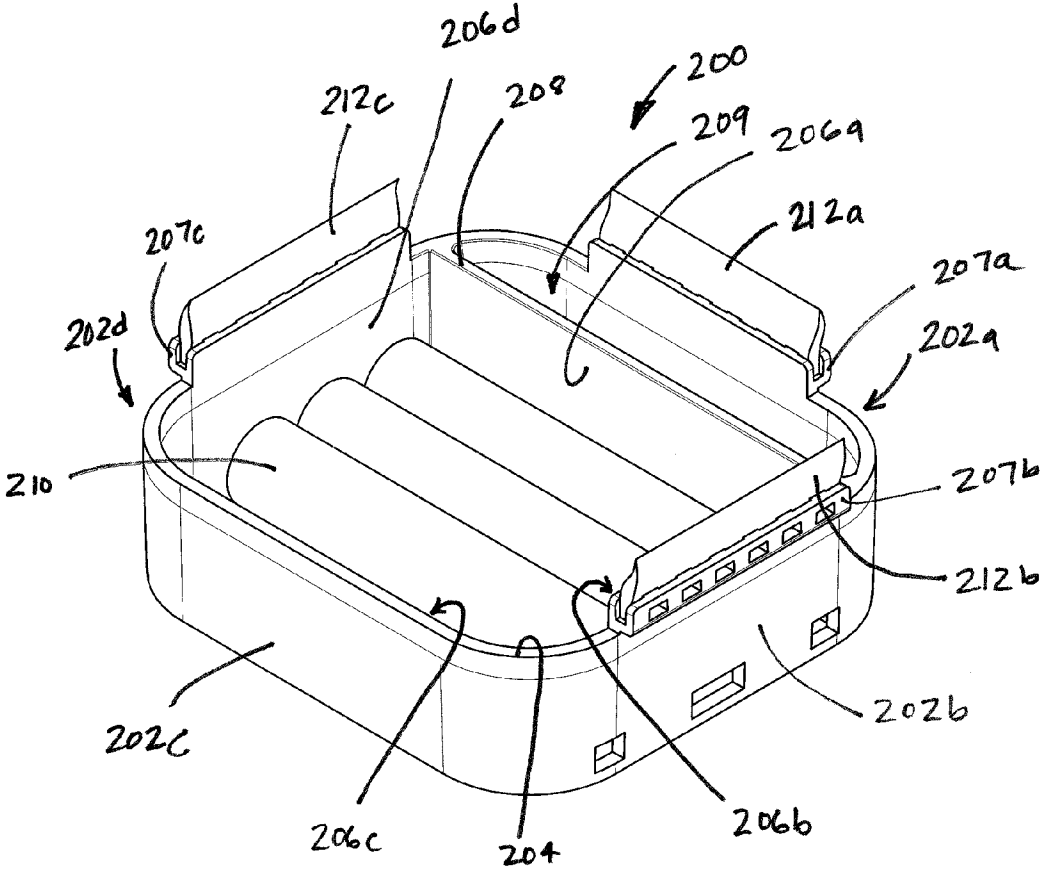
FIG. 3 is a perspective view of a sanitation device insert according to one embodiment of the invention.
Figure 4:
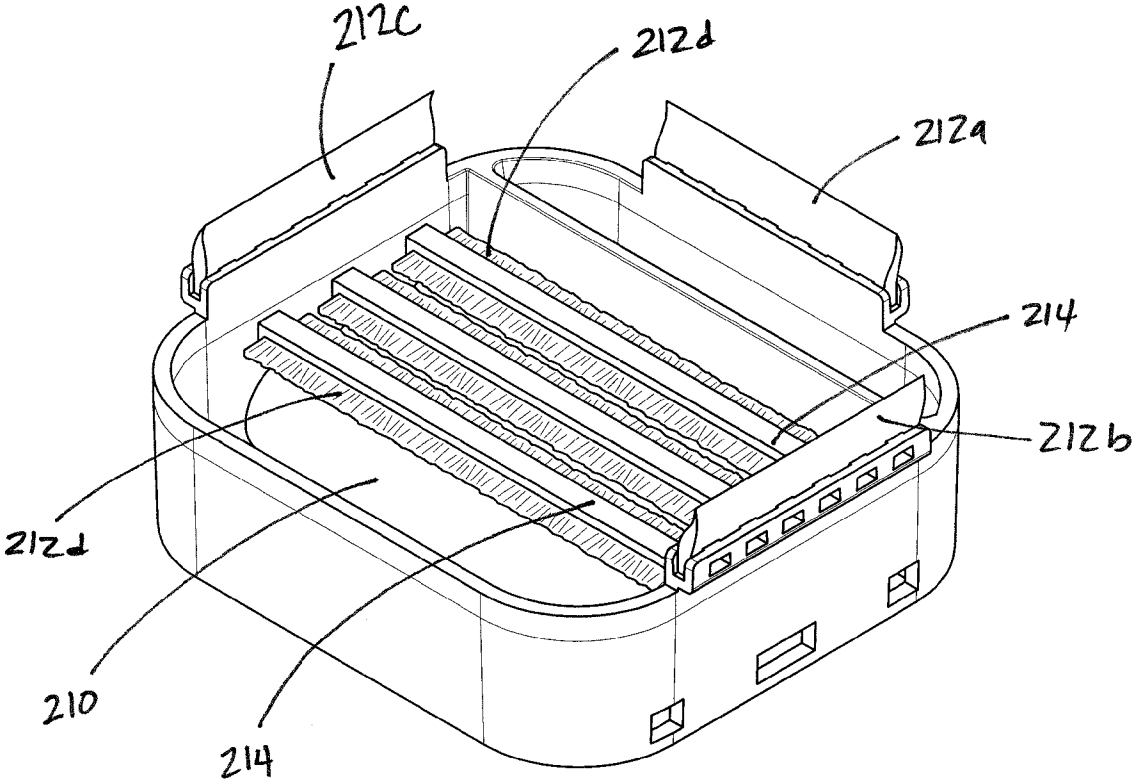
FIG. 4 is another perspective view of a sanitation device insert according to another embodiment of the invention.

Referring now to FIGS. 3 and 4, the insert 200 may have sidewalls 202*a*, 202*b*, 202*c*, and 202*d* which are substantially vertical to allow the insert 200 to fit inside the upper periphery 154 of the container 150, for example, resting atop the edge 153. Accordingly, the perimeter of the insert 200 may generally correspond to the perimeter of the upper periphery 154. The insert 200 may be constructed of molded plastic, for example.

One or more receptacles 207*a*, 207*b*, 207*c* (generally, 207) may be formed along a top rim 204 of the insert 200 and configured to retain a respective scraping member 212*a*, 212*b*, 212*c* (generally, 212). The scraping members 212 may be additionally secured in the respective receptacles 207 via an adhesive, although it may be understood that the scraping member 212 may need to be removed and replaced occasionally. Accordingly, temporary attachment of the scraping member 212 may be preferable.

The scraping member 212 may be any device capable of removing debris and/or liquid from a utensil. For example, acceptable scraping members include squeegees, sponges, scouring pads, brushes, or similar instruments. One of ordinary skill in the art may also recognize that it may be beneficial to incorporate a variety of scraping members, such as a squeegee and a sponge. In one embodiment, the insert 200 has at least two squeegees 212, one for removing debris and a second to exsiccate liquid after the utensil is removed from the sanitizing solution. In another embodiment, illustrated in FIG. 4, a plurality of rubber membranes or squeegees 212*d* may extend outwardly from supports 214. As is described in greater detail below, the rubber membranes 212*d* may dry off utensils as they are removed from the sanitizer solution.

As mentioned above, it is imperative that contaminated utensils do not come into contact with food for human consumption. Accordingly, it is important that utensils that have been sanitized are not again accidentally contaminated. Accordingly, the squeegees 212 (or other scraping member) may be distinguished from each other by different colors or sizes, for example. Hence, the person cleaning the utensil can easily recognize a squeegee that is for debris removal versus a squeegee that is meant to remove excess sanitizer solution, thus avoiding accidental contamination of the utensil which would require a second (or more) immersion into the sanitizer solution.

A partition 208 may extend between two opposing side walls (e.g., 202*b* and 202*d*) to form a debris channel 209. As described in greater detail below, the channel 209 may catch debris from utensils to prevent the container 150 from becoming congested with unwanted debris. Accordingly, a floor may be provided under the channel 209.

Opposing ends of at least one cleaning rod 210 may be mounted along opposing inside faces (e.g., 206*b* and 206*d*) of the insert sidewalls 202*b* and 202*d* for cleaning utensils such that the rod 210 is parallel with the partition 208. Alternately, the rod 210 may extend from an inside face 206*a* of the partition 208 to an inside face of the opposing side wall 206*c*. Apertures in the opposing inside faces 206*b* and 206*d* may receive respective ends of the cleaning rod 210 to hold the rod 210 in place. The cleaning rod 210 may be removable from the inside faces 206*b* and 206*d* such that the rod 210 may be exchanged as needed. Alternately, respective ends of the rod 210 may be adhered inside the apertures in the opposing side faces 206*b* and 206*d*.

It may be recognized that multiple cleaning rods 210 may preferably be incorporated into the insert 200 to more effectively clean utensils. Moreover, it shall be recognized that the cleaning rods 210 may be provided in other alternative configurations. For example, the rods 210 may be provided around the perimeter of the insert 200, rather than extending between opposing side walls 202*b* and 202*d* or 202*a* and 202*c*.

In a preferable embodiment, the cleaning rods 210 may be, for example, twisted-wire brushes having bristles made of a polymer (such as nylon) or other appropriate material. Other types of cleaning tools may additionally, or alternately, be incorporated into the insert 200. For example, in some embodiments, the cleaning rods 210 may be equipped with sponges, scouring pads, et cetera.

The diameter of the bristles on each of the brushes 210 may be the same (e.g., 3/16") or varied (e.g., 3/16", 5/8", and 1 3/8", et cetera) based on the needs of the particular application. For instance, brushes with smaller bristle diameters may be better equipped to remove debris that is caked on a utensil, while brushes with larger bristle diameters may be useful for cleaning less-soiled utensils. Regardless of the size of the bristles, it may be beneficial for the bristles of the brushes 210 to overlap such that more than one side of a utensil may be cleaned at a time.

As noted above, the drying basket 250 may be configured to fit into the corresponding aperture 124 in the attachment 120. The basket 250 may be further configured such that cleaned and sanitized utensils can be safely stored therein. For example, it will be understood by those of skill in the art that the basket 250 is sufficiently designed such that the length can adequately hold sharp utensils (e.g., knives) of all sizes without a risk of the utensils prematurely falling out of the basket. The drying basket 250 may have a plurality of apertures 252 formed therein so as to allow air to pass through the basket 250 and dry the stored utensils stored therein.

It may be preferable for the basket 250 to be formed from a material that is resistant to sharp edges (such as those from a knife) and water damage, such as aluminum or stainless steel. It may additionally be desirable for the basket 250 to be formed of a material that may help prevent the utensils from slipping in the basket 250, such as rubber. Alternately, the basket 250 may be formed from a material such as stainless steel or aluminum and coated with rubber or similar material.

In use, a user of the system may take a soiled utensil and rub the utensil along one of the scraping members 212, such as scraping member 212*a* shown in FIG. 3. The debris from the utensil may fall into the debris basket 209. The user may then insert the utensil through the top of the insert 200 such that the utensil comes into contact with at least one of the cleaning rods 210 and into the container 150 which holds a cleaning solution. As the utensil is inserted further into the container 150, the utensil comes into contact with the cleaning solution. The user may then remove the utensil from the container 150 and the insert 200. This process may be completed until the utensil is cleaned and sanitized.

Once the utensil is cleaned and sanitized, excess liquid may be removed from the utensil by scraping the utensil against another squeegee 212, such as 212*b* or 212*c*. The excess liquid may run back into the container 150. The utensil may then be placed in the drying basket 250 to complete the drying process. Alternately, the utensil may immediately be used.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations are of utility and may be employed within the scope of the disclosure. Further various steps set forth herein may be carried out in orders that differ from those set forth herein without departing from the scope of the present methods. This description shall not be restricted to the above embodiments.

The invention claimed is:

1. A system for sanitizing a utensil, comprising:

a shelf removably attached to a counter;

an attachment member adjustably secured to the shelf, the attachment member having an aperture formed therein;

a container received into the aperture in the attachment member, the container being configured to hold a sanitizing solution; and a removable insert located along an upper periphery of the container;

wherein the removable insert comprises:

a first cleaning rod extending between opposing first and second sides of the insert;

a partition extending between the opposing first and second sides of the insert parallel to the first cleaning rod to form a debris channel, the debris channel having a floor thereunder; and at least one scraping member secured to an upper rim of the insert; and wherein the first cleaning rod is not located in the debris channel.

2. The system of claim 1, wherein the removable insert further comprises a second cleaning rod, and wherein the second cleaning rod is one of: secured between the opposing first and second sides of the insert parallel to the first cleaning rod or secured between opposing third and fourth sides of the insert perpendicular to the first cleaning rod.

3. The system of claim 2, wherein each cleaning rod comprises a rod and a covering, the covering being selected from the group consisting of: brushes, a sponge, and a scouring pad.

4. The system of claim 3, wherein the first and second cleaning rods are brushes having polymer bristles, and wherein a diameter of the bristles of the first cleaning rod is not the same as the diameter of the bristles of the second cleaning rod.

5. The system of claim 4, wherein the cleaning rods are angled.

6. The system of claim 2, further comprising a plurality of scraping members secured to the upper rim of the insert, at least one scraping member being configured to remove debris from the utensil into the debris channel and another scraping member being configured to remove sanitizing solution from a sanitized utensil.

7. The system of claim 6, wherein each scraping member is selected from the list consisting of: a squeegee, a sponge, a brush, and a piece of textile.

8. The system of claim 7, wherein the scraping members are squeegees.

9. The system of claim 2, wherein the insert further comprises a wiping member secured to an inside face of at least one of the first, second, third, and fourth sides of the insert above the cleaning rods, the wiping member being a squeegee or a rubber membrane configured to remove sanitizing solution from the sanitized utensil.

10. The system of claim 1, wherein the attachment member is secured to the shelf via a mechanical fastener such that the attachment member rotates between an open position and a closed position.

* * * * *